US008445805B2

(12) United States Patent
Glaser

(10) Patent No.: US 8,445,805 B2
(45) Date of Patent: May 21, 2013

(54) VACUUM SWITCH WITH PRE-INSERTION CONTACT

(76) Inventor: Michael David Glaser, Brookfield, WI (US)

( * ) Notice: Subject to any disclaimer, the term of this patent is extended or adjusted under 35 U.S.C. 154(b) by 405 days.

(21) Appl. No.: 12/986,548

(22) Filed: Jan. 7, 2011

(65) Prior Publication Data

US 2012/0175347 A1 Jul. 12, 2012

(51) Int. Cl.
*H01H 33/66* (2006.01)

(52) U.S. Cl.
USPC ..... 218/140; 218/120

(58) Field of Classification Search
USPC ..... 218/140, 10, 14, 118–120, 153, 154
See application file for complete search history.

(56) References Cited

U.S. PATENT DOCUMENTS

| | | | | | |
|---|---|---|---|---|---|
| 2,539,175 | A | * | 1/1951 | Balentine | 218/115 |
| 2,863,026 | A | | 12/1958 | Jennings | |
| 3,566,061 | A | | 2/1971 | Bernatt | |
| 3,576,414 | A | | 4/1971 | Mikos | |
| 3,588,406 | A | | 6/1971 | Bernatt | |
| 3,590,186 | A | | 6/1971 | Brunner | |
| 3,763,340 | A | | 10/1973 | Noack | |
| 4,069,406 | A | | 1/1978 | Meinders | |
| 4,072,836 | A | | 2/1978 | Bischofberger et al. | |
| 4,324,959 | A | | 4/1982 | Hall et al. | |
| 4,383,150 | A | | 5/1983 | Cromer et al. | |
| 4,434,332 | A | * | 2/1984 | Yanabu et al. | 218/144 |
| 4,695,918 | A | | 9/1987 | O'Leary | |
| 4,788,390 | A | * | 11/1988 | Crino | 218/143 |
| 5,917,167 | A | | 6/1999 | Bestel | |
| 6,172,317 | B1 | * | 1/2001 | Wristen | 218/138 |
| 6,255,615 | B1 | | 7/2001 | Kimblin | |
| 6,720,515 | B2 | | 4/2004 | Renz et al. | |
| 6,921,989 | B2 | | 7/2005 | Baranowski et al. | |
| 2008/0245772 | A1 | | 10/2008 | Anger et al. | |

* cited by examiner

*Primary Examiner* — Tulsidas C Patel
*Assistant Examiner* — Marina Fishman
(74) *Attorney, Agent, or Firm* — Donald J. Ersler

(57) ABSTRACT

A vacuum switching device with pre-insertion contact arrangement is disclosed. The vacuum switch includes first and second contact systems. The first contact system includes an annular stationary contact and an annular moving contact retained on a moving contact drive rod. A second contact system includes a moving contact retained on an end of the moving contact drive rod and a floating contact retained along the same axis as the second moving contact. Both contact systems are enclosed in a vacuum envelope. A mechanical adjustment system is provided for the floating contact, which allows it to be positioned so that the secondary moving contact and floating moving contact may engage at a set interval before the annular moving contact engages the annular stationary contact. A resistor or inductor is connected between the second contact system and a load to prevent a current in-rush into the load.

19 Claims, 4 Drawing Sheets

VACUUM SWITCH WITH PRE-INSERTION CONTACT

BACKGROUND OF THE INVENTION

1. Field of the Invention

The present invention relates to the field of high voltage vacuum switches and circuit interrupting devices and more particularly to a vacuum switch with a pre-insertion resistor or inductor arrangement to limit transient in-rush currents and or voltage transients during the closing and opening of a power distribution circuit containing capacitor banks.

2. Discussion of the Prior Art

A number of vacuum and non-vacuum prior art arrangements are directed to pre-insertion resistors or inductors for circuit interrupting devices wherein a resistor or inductor is either inserted in series with a high voltage switch or in parallel with a switch gap during the closing movement of the switch or interrupting unit to reduce audible and electrical noise and to limit transient in-rush current and/or voltages incident to completion of the circuit by the switch or interrupting unit. For example pre-insertion resistors of this type are shown in the following U.S. Pat. Nos. 3,588,406; 3,576,414; 3,566,061; 3,590,186; 3,763,340; 4,069,406; 4,072,836; 4,324,959; 4,695,918 and 4,788,390. Without the pre-insertion resistor, as the circuit interrupting device is closed, the in-rush current may reach values of 10 to 30 thousand amperes, where the interrupting device is used in conjunction with back to back capacitor banks. Additionally, during energization of a single capacitor bank, large voltage transients may also be produced. Such transient current and/or voltages can produce undesirable noise both audible and electrical and can, of course, also lead to distress or damage to equipment connected to the circuit. With the pre-insertion resistor, the in-rush current arising from switching back to back capacitor banks is limited to much lower values, perhaps in the range of 1.5 to 4 thousand amperes, which can be carried by the circuit without undue distress. Since the pre-insertion resistor or inductor is in the circuit only briefly during the closing of the circuit interrupting device, the pre-insertion resistor or inductor is not required to carry the continuous current of the circuit except during the portion of the insertion time after the in-rush. The vacuum devices of this type rely on complex and costly external switching techniques, while the non-vacuum devices rely on an air switch, which is quite noisy and bulky or SF6 devices, which are now creating environmental concerns due to the affect of escaped SF6 gas on the ozone layer.

Another approach to damping or limiting the current in-rush incident to the completion of the capacitor bank circuit by a high voltage switch is the continuous, permanent connection of an inductor in the circuit. However, such an arrangement does have its drawbacks since the inductor must be designed to carry continuous load currents and fault currents. In addition, there are ongoing costs associated with power losses in the inductor on a continuous basis as well as a reduction in the effectiveness of the capacitor bank to which it is connected.

Vacuum interrupters have been used in series combinations or with other circuit interrupting devices to provide a pre-insertion means. U.S. Pat. No. 3,708,638 illustrates two vacuum circuit breakers connected in series with an electronic control system to close one breaker before the other. This results in an arrangement that is complex and costly. U.S. Pat. No. 4,383,150 illustrates a vacuum interrupter combined with an SF6 interrupter. The combination of the two interrupters results in a switching device, which is also complex, costly and has the aforementioned environmental concerns associated with SF6 gas.

Prior art electronically controlled vacuum switches have allowed for precise closing on a voltage zero which minimizes the in-rush current and voltage transients as is illustrated in U.S. Pat. No. 6,921,989 B2. The electronic control employees a feedback circuit to determine the exact location and speed of the contact operating means so that the vacuum switch can be closed on a voltage zero of the sinusoidal waveform of the electric supply line. This type of vacuum switch is quite complex and costly, and can be difficult to set up when utilized in three phase applications.

Other prior art vacuum interrupters utilize multiple contact systems in an axial configuration as illustrated in U.S. Pat. Nos. 6,255,615 B1, 6,720,515 B2 and patent application US 2008/0245772 A1. These vacuum interrupters engage one set of contacts by having the contact operating means move in one direction and engage a second set of contacts when the contact operating means moves in the opposite direction. This configuration is suitable for providing a means to ground the electric circuit in which the vacuum switch or interrupter is employed, but because the contact means is not capable of engaging both sets of contacts by moving in one direction, the vacuum interrupters do not provide a pre-insertion means.

Another prior art interrupter utilizes multiple contact systems wherein one set of contacts drives another as illustrated in U.S. Pat. No. 2,863,026. In this case the operating spring for the driven contact is mounted inside the interrupter and is subject to annealing during the brazing together of the interrupter. While work hardening will result in the return of some of the spring force characteristics, its final force characteristics will be uncontrolled. Additionally, this device is not suitable as a pre-insertion device as no means is provided to precisely position the driven contact or to adjust out the tolerance accumulation between the multiple parts.

While the aforementioned prior art arrangements may be suitable for their intended use in accordance with their respective defined applications, as discussed hereinbefore, it would be desirable to provide an efficient and compact pre-insertion contact arrangement contained within a vacuum switch module to limit transient in-rush currents and voltage transients.

SUMMARY OF THE INVENTION

Accordingly, it is the principal object of the present invention to provide a single vacuum switch module with pre-insertion contacts activated by the motion of the main contacts and a resistor or inductor arrangement that effectively limits transient in-rush currents and/or voltages during operation of the device and does not require high energy dissipation, complex mechanical or electronic switching systems or precise insertion timing.

In the practice of the invention, the primary contact system has an annular stationary contact, which is engaged by a disc shaped moving contact. Both contacts are of copper-tungsten material, which is generally used for switching applications. The base of the stationary contact is supported between two tubular insulators, which are preferably made of ceramic and form the main portion of the interrupter housing. One of these insulators contains the first contact system. The end of this insulator is closed off by a stainless steel or monel end-cup which has an opening for the contact drive rod. The contact rod is made of copper with a stainless steel reinforcing rod to prevent a reduction in length due to repeated impact. A flexible stainless steel bellows is used to allow motion of the drive rod and allow for sealing of the end-cup. The drive rod for the moving contact disc extends through the disc and annular stationary contact into the region of the second insulator. A second moving contact disc is mounted on the end of the drive rod and is engaged by a floating contact disc mounted on a floating contact rod. These contacts are also of copper-tungsten material and the floating contact rod is also copper with a stainless steel reinforcing rod. This contact rod is mounted on the other end of the second insulator using a bellows and end-cup arrangement to allow sealing and free motion of the floating contact. The floating contact is driven by the motion of the second moving contact, which is directly coupled to the first contact system.

A mechanism is mounted on the end-cup that supports the floating contact and allows the tolerance accumulation of the components to be adjusted out and the floating contact positioned so that the second moving contact and floating contact can close before the primary contacts. The mechanism also has the capability of controlling the range of motion of the floating contact so that it may be contacted by the second moving contact for a set time before the primary contacts close.

The mechanism includes an annular housing with two long slots along the main axis spaced 180 degrees apart. The length of these slots is the sum of the length of the slots in the threaded adjuster described below plus the full range of tolerance accumulation of all parts that determine the spacing between the primary and secondary contacts. This allows the mechanism to have the capability of adjusting-out the tolerance build-up in the system. The housing also has an internal thread to allow the insertion of the threaded adjuster. The floating contact rod for the floating contact has a cross-hole placed in a position to allow the threaded adjuster to move through its required range within the housing. A fixturing pin is inserted through a hole in the floating contact rod and passes through both slots cut into the housing. In this manner, when the interrupter is processed through a brazing cycle, the relationship between the floating contact rod and housing is established and the housing can also be used as a bellows anti-twist device. After the interrupter is brazed, the fixturing pin is removed and an annular adjuster with external thread is screwed into the housing. The threaded adjuster has six slots spaced 60 degrees apart and of a length that is calculated to provide the desired time that the secondary contact system engages before the primary contact system, plus a small amount of over travel to accommodate any erosion or compression of the primary contacts. The threaded adjuster also has a counter-bore into which a compression spring or series of Bellville washers may be inserted. With the primary contacts held together and the secondary contacts in contact with each other, the threaded adjuster is rotated so that the top of the slot is above the cross-hole in the floating contact rod by the planned over-travel distance. The multiple slots in the threaded adjuster allows for a finer adjustment in determining this setting. Once the adjustment is complete, a pin is inserted so that it passes through the housing, floating contact rod and threaded adjuster and is secured with washers and retaining rings at both ends. A compression spring or series of Bellville washers of appropriate design to provide the required contact pressure for the secondary contacts and return force for the floating contact is placed in the counter-bore of the threaded adjuster and is secured in place with a threaded cap. This forces the pin through the floating contact rod to the lower portion of the adjuster slot and establishes the setting so the secondary contacts engage before the moving contacts.

A portion of the floating contact rod extends through the cap that captures the compression springs to which a flexible lead or other current exchange method (garter springs or multi-lam current transfer devices) may be attached. A pre-insertion resistor or inductor of appropriate design is attached from the established current exchange to a load terminal located on the base of the stationary contact of the primary set of contacts. A current exchange is also required for the moving contact rod for the primary set of contacts as this is a source terminal for the vacuum switch. As the primary contact rod moves to the closed position, it can be seen that the secondary contacts will close first which will allow current to flow from the source terminal connected to the primary rod, through the secondary contacts and pre-insertion resistor or inductor and out to the load terminal at the base of the stationary contact. As the primary contact rod continues its motion, the second moving contact pushes the floating contact, compressing the spring contained in the adjustment mechanism until the primary contacts engage. Once the primary contacts engage they short out the circuit consisting of the secondary contacts and pre-insertion resistor or inductor and thus effectively remove the pre-insertion resistor or inductor from the circuit. Current then flows unimpeded from the source terminal through the primary contacts to the load terminal. This motion allows the pre-insertion resistor or inductor to be momentarily connected in a capacitor bank application and then removed to allow efficient flow of the capacitor bank load current. As the moving contact rod is moved to the open position, the previously charged spring in the adjustment mechanism now discharges and forces the secondary contacts to remain engaged for a time after the primary contacts part. This reduces arcing on the primary contacts and places the pre-insertion resistor or inductor momentarily in series with the capacitor bank to reduce transients when the secondary contacts break the circuit. The invention described above is suitable for use in oil or SF6 switchgear.

A ramification of the invention allows the vacuum switch to be encapsulated. This is facilitated by the addition of a housing, which prevents the encapsulation material from contacting the moving components of the threaded adjuster. The housing consists of a metallic cylinder with a top made of insulating material. The portions of the housing are held in place by screws, which engage insulators, which are secured to studs that are brazed to the end-cup of the interrupter. A flexible lead transfers current from the floating contact rod to a terminal, which exists out the top of the housing. A terminal rod is extended out from the stationary contact and a current exchange utilizing a multi-lam construction and bellows anti-twist means is utilized with the primary moving contact. A terminal rod is extended out from this current exchange, in the opposite direction to that on the stationary contact to maximize terminal dielectric clearances. This configuration may be encapsulated using the various techniques established in prior art. Once encapsulated, the pre-insertion resistor or inductor may be mounted externally between the top terminal and the terminal connected to the stationary contact.

DESCRIPTION OF THE PREFERRED EMBODIMENTS

Figure 1:
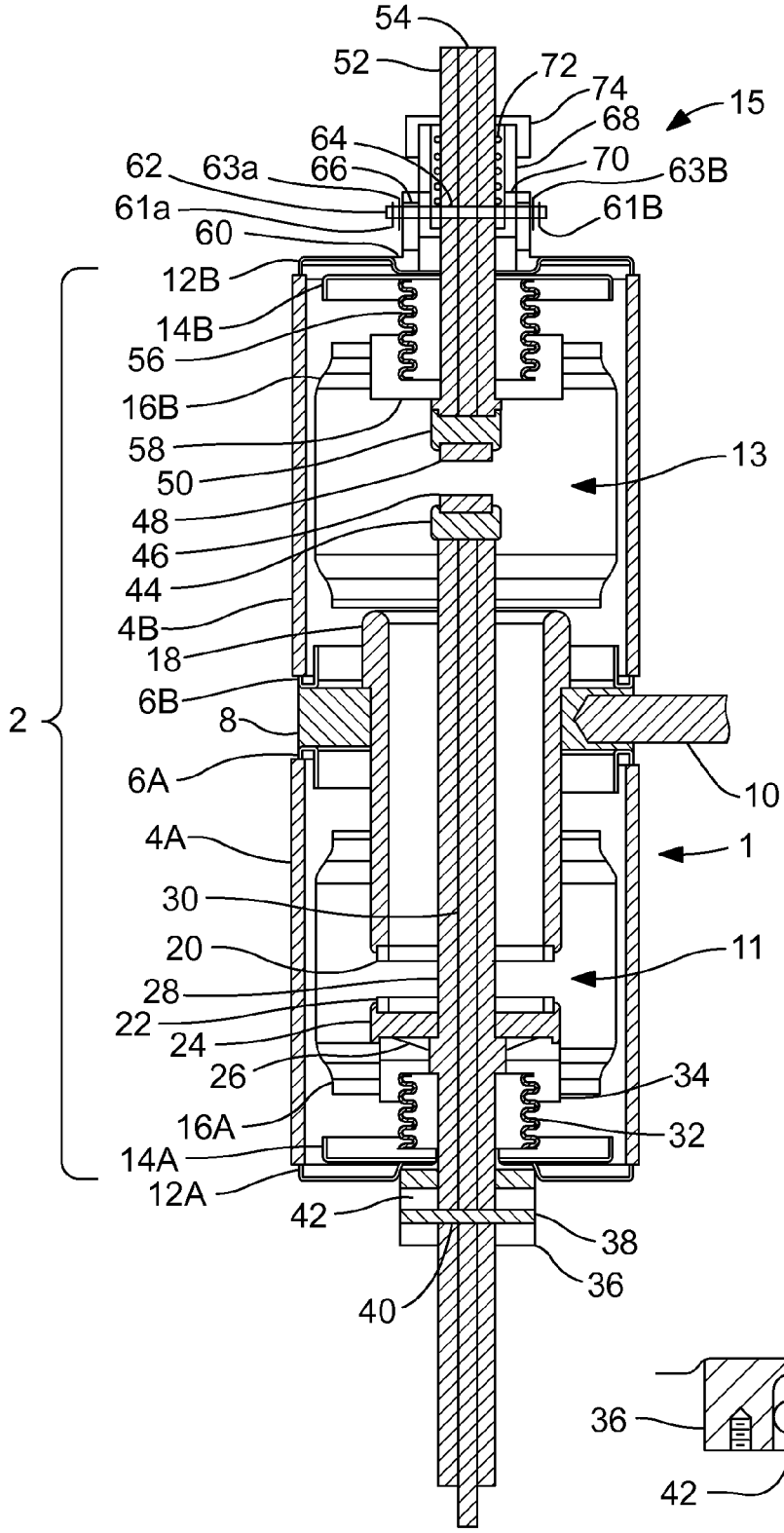
FIG. 1 is a cross-sectional view of a vacuum switch with pre-insertion contact including a vacuum envelope in accordance with the present invention.

FIG. 1 discloses a vacuum switch with pre-insertion contact (vacuum switch) 1. The vacuum switch 1 includes a vacuum envelope 2. The major part of the vacuum envelope 2 includes a pair of insulating cylinders 4A and 4B preferably fabricated from alumina ceramic and joined end-to-end by way of two stainless steel or monel triple point shields 6A and 6B and a stationary contact support ring 8 preferably fabricated from copper. A threaded hole in the stationary contact support ring 8 allows the attachment of a terminal rod 10 preferably fabricated from copper to facilitate electrical connection to the load line. The opposite ends of the ceramic cylinders are enclosed by two end cups 12A and 12B preferably fabricated from stainless steel or monel.

A second set of triple point shields 14A and 14B preferably fabricated from stainless steel or monel are attached to the end cups 12A and 12B. A generally tubular internal shield 16A and 16B is provided within each insulating cylinder 4A and 4B spaced from the interior wall and overlapping the triple point shields 14A and 14B to prevent any vaporized material from contacting the interior wall.

A primary contact system 11 includes an annular stationary contact support 18 preferably fabricated from copper and is attached to the stationary contact support ring 8. An annular stationary contact 20 preferably fabricated from copper tungsten is attached to a lower end of the stationary contact support 18. The annular stationary contact 20 is engaged with an annular moving contact 22 and also preferably fabricated from copper tungsten.

The annular moving contact 22 is attached to a disc shaped moving contact support 24 preferably fabricated from copper. The moving contact support 24 is reinforced by a moving contact reinforcement cone 26 preferably fabricated from stainless steel. Both the moving contact support 24 and the moving contact reinforcement cone 26 are on a moving contact rod 28 preferably fabricated from copper. The moving contact rod 28 is reinforced by a reinforcing rod 30 preferably fabricated from stainless steel and is sealingly passed through the end cup 12A and the triple point shield 14A by a bellows 32 to allow electrical connection to the source line. The bellows 32 is preferably fabricated from stainless steel. The end of the reinforcing rod 30 is preferably threaded and extends beyond the lower end of the moving contact rod 28 to facilitate the attachment of a drive rod from an external drive mechanism (not shown). The bellows 32 is preferably protected from vaporized material damage by a bellows shield 34. The bellows shield 34 is preferably fabricated from stainless steel.

Figure 1A:
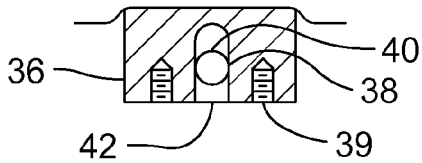
FIG. 1*a* is an enlarged cross-sectional side view of a bellows anti-twist housing of a vacuum switch with pre-insertion contact in accordance with the present invention.

A bellows anti-twist housing 36 preferably fabricated from stainless steel is attached to the opposite side of end cup 12A and is centered by a circular depression formed in the end cup 12A. With reference to FIG. 1*a*, the bellows anti-twist housing 36 is indexed to the moving contact rod 28 by a hardened pin 38 preferably fabricated from nickel plated steel, which passes through a cross-hole 40 in the moving contact rod 28 and slides in a slot 42 in the bellows anti-twist housing 36. Two threaded holes 39 are formed in the bellows anti-twist housing 36 to facilitate attachment of a current exchange housing 126.

A second contact system 13 includes the extension of the moving contact rod 28, which passes through the moving contact support 24. A disc shaped moving contact support 44 preferably fabricated from copper is attached to an end of the moving contact rod 28. A moving contact disc 46 preferably fabricated from copper tungsten is attached to the moving contact support 44. The second contact system 13 further includes a floating contact 48 preferably fabricated from copper tungsten, which is attached to an end of a disc-shaped floating contact support 50 preferably fabricated from copper. The floating contact support 50 is attached to a floating contact rod 52 preferably fabricated from copper, which is reinforced by a reinforcing rod 54 preferably fabricated from stainless steel and sealingly passed through the end cup 12B and triple point shield 14B by a bellows 56. Bellows 56 is protected from damage by vaporized material by a bellows shield 58. The bellows 56 and the bellows shield 58 are preferably fabricated from stainless steel. A mechanism housing 60 preferably fabricated from stainless steel is attached to the opposite side of end cup 12B and is centered by the circular depression formed in the end cup. The mechanism housing 60 is indexed to the floating contact rod 52 by a hardened pin 62 preferably fabricated from a nickel plated steel passes through a cross-hole 64 in the floating contact rod 52 and slides in a slot 66 in the mechanism housing 60. During a brazing cycle for the vacuum switch pin 62; the vacuum switch pin 62 is replaced by a fixture pin to assure the alignment of these parts.

An operating mechanism for the floating contact 15 includes the mechanism housing 60 into which is threaded a threaded adjuster 68 preferably fabricated of brass. The mechanism housing 60 has two slots 66 located at opposite sides of its circumference. The threaded adjuster 68 preferably has six slots 70 equally spaced around its perimeter so that pin 62 can be inserted into any opposite facing pair of slots 70 during the adjustment process. When threading the threaded adjuster 68 into the mechanism housing 60, the pin 62 is withdrawn from the mechanism housing 60. The threaded adjuster 68 is positioned so that one pair of slots 70 line up with the cross hole 64 in the floating contact rod 52. A top of the slot 70 is preferably 0.031 inch above cross-hole 64.

During this adjustment, both the first and second set of contacts must be closed. The pin 62 is then inserted back through the mechanism housing 60, the threaded adjuster 68 and the floating contact rod 52. The pin 62 is held in place by a pair of retaining rings 61A and 61B and a pair of washers 63A and 63B. The retaining rings 61A, 61B and the pair of washers 63A, 63B are both preferably fabricated from steel. A compression spring 72 preferably made of music wire is inserted into a counter-bore in threaded adjuster 68 and a threaded spring retainer 74 is tightened. The threaded spring retainer is preferably fabricated from a nickel plated steel. The pin 62 prevents rotation of the floating contact rod 52 relative to the mechanism housing 60.

The compression spring 72 forces the pin 62 to the bottom of the slot 70. The length of the slots 70 in the threaded adjuster 68 is calculated to provide a desired pre-insertion time based on the speed of the contacts plus an allowance for wear of the contacts. For example, with a contact speed of 3 feet/second and allowable wear of 0.031 inch, the slot 70 would be approximately 0.187 inch long end to end. The slots 66 in the mechanism housing 60 have a minimum length equal to the tolerance build-up between the location of the cross hole 64 in floating contact rod 52 and the end of the second moving contact 46 plus the length of the slots 70 in the threaded adjuster 68. This allows the threaded adjuster 68 to be able to be adjusted through the full range of possible locations of the cross hole 64.

Figure 2:
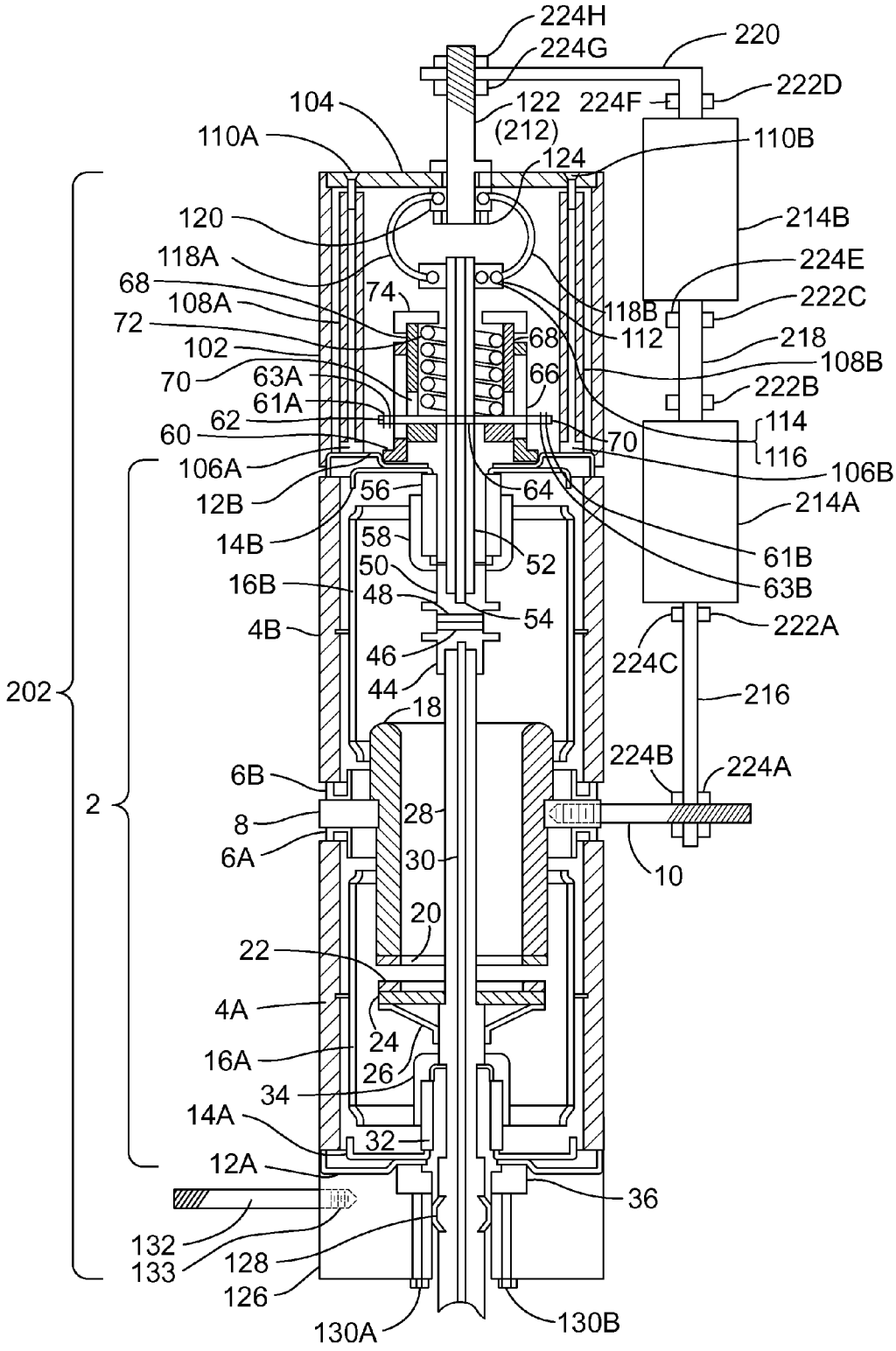
FIG. 2 is a cross-sectional view of a vacuum switch with pre-insertion contact prepared for encapsulation in accordance with the present invention.

In order to facilitate encapsulation of an end of the vacuum switch 1; a cover housing 102 and cover plate 104 are placed over the mechanism housing 60 as shown in FIG. 2. The cover housing 102 is preferably fabricated from an aluminum material. The cover plate 104 is preferably fabricated from an insulating material such as GP01 or GP03 fiberglass or G10 epoxy glass.

A pair of studs 106A and 106B preferably fabricated from stainless steel are attached to an outside surface of the end cup 12B. An insulating stringer 108A and 108B preferably fabricated from a filament wound epoxy glass is threaded onto each stud 106A and 106B. A screw 110A and 110B preferably fabricated from stainless steel is threaded into an opposite end of each stringer 108A and 108B to retain the cover plate 104 and the cover housing 102. A split-clamp connector 112 preferably fabricated from copper is tightened onto an end of floating contact rod 52 using a bolt 114 and a nut 116. A pair of highly flexible multi-stranded conductors 118A and 118B preferably fabricated from copper are conductively secured to the split clamp connector 112 on one end and to a terminal connector 120 preferably fabricated from copper on the other end thereof. The terminal connector 120 is preferably threaded onto a lower portion of a pre-insertion terminal 122 and secured with a jam nut 124; creating a current exchange between the floating contact rod 52 and the pre-insertion terminal 122. The terminal connector 122 is preferably fabricated from copper and the jam nut 124 from brass.

The opposite end of the vacuum switch 1 is prepared for encapsulation by installation of the current exchange housing 126 preferably fabricated from copper and a multi-lam contact 128. The current exchange housing 126 is placed over the bellows anti-twist housing 36. The multi-lam contact 128 provides electrical contact between the moving contact rod 28 and the current exchange housing 126. The current exchange housing 126 is secured to the bellows anti-twisting housing 36 with a pair of bolts 130A and 130B preferably fabricated from stainless steel. A threaded hole 133 in a perimeter of the current exchange housing 126 allows the attachment of a terminal rod 132 preferably fabricated from copper to facilitate electrical connection to a source line.

Figure 3:
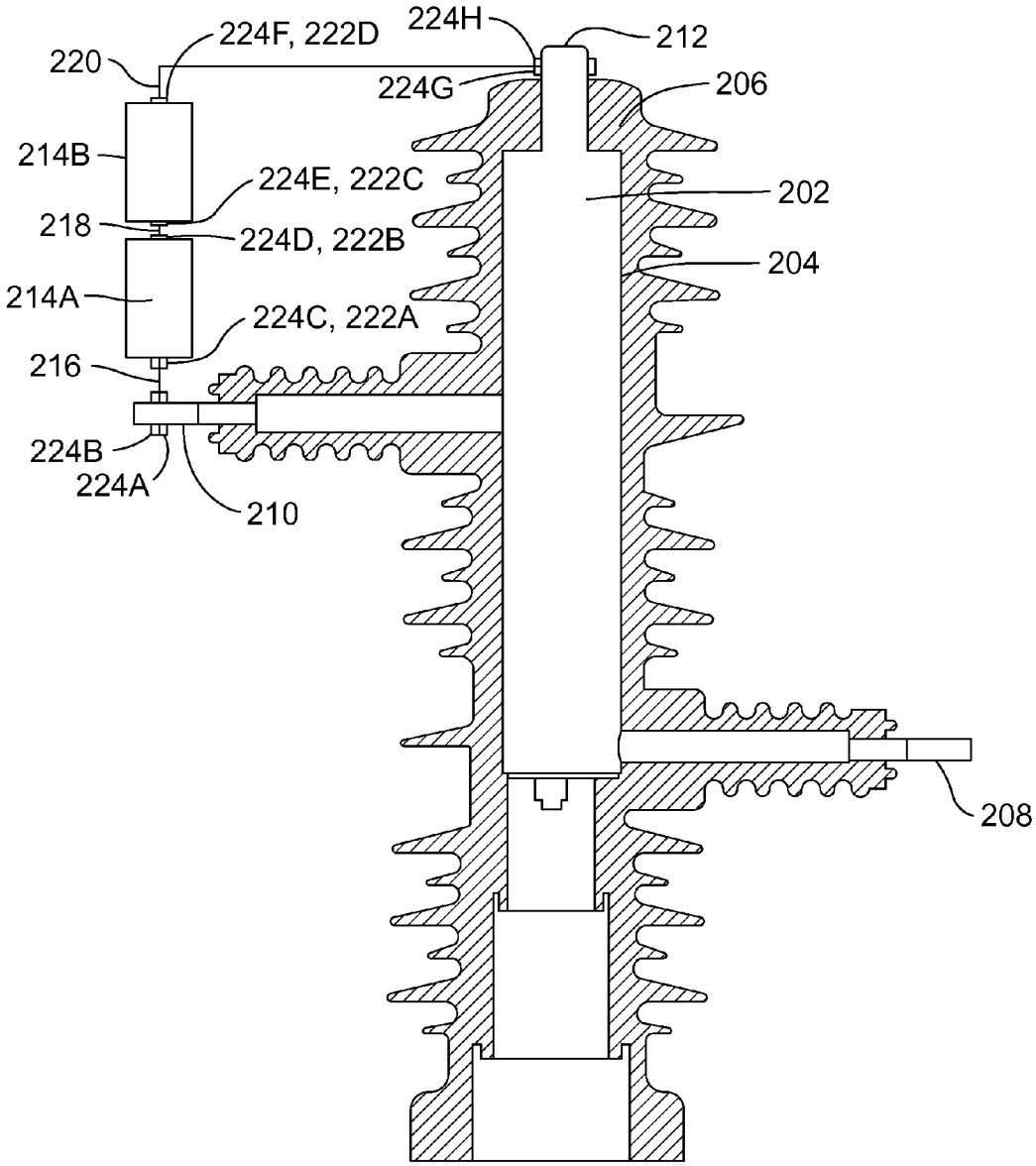
FIG. 3 is a cross-sectional view of a method of encapsulating a vacuum switch with pre-insertion contact in accordance with the present invention.

There are several examples of prior art patents, which show the encapsulation of vacuum modules. FIG. 3 indicates one possible way of encapsulating the aforementioned vacuum switch as demonstrated by U.S. Pat. No. 5,917,167. In this case, a substantial portion of the invention 202 is encased in a tube 204 and cast in an encapsulation 206. The tube 204 is preferably a silicone rubber and the encapsulation is preferably an epoxy. The result is a three terminal encapsulation with a source terminal 208, a load terminal 210 and a pre-insertion terminal 212. A pair of pre-insertion resistors or inductors 214A and 214B are connected from the pre-insertion terminal 212 to the load terminal 210 utilizing [stainless steel] brackets 216, 218 and 220, [tin plated phosphor bronze] bolts 222A-D and [tin plated phosphor bronze] nuts 224A-H. The brackets 216-220 are preferably stainless steel. The bolts 222A-D and nuts 224A-H are preferably fabricated from tin plated phosphor bronze. This places the pre-insertion components electrically in series with the aforementioned second contact system and this series combination electrically in parallel with the first contact system.

Figure 4:
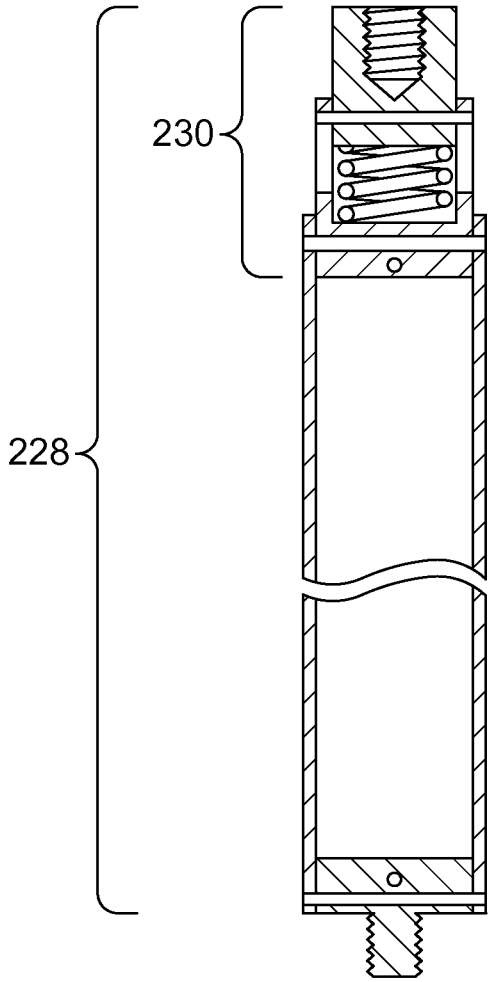
FIG. 4 is a cross-sectional view of an operating rod for coupling a vacuum switch with pre-insertion contact to an operating mechanism in accordance with the present invention.

In operation, the aforementioned encapsulated vacuum switch would be coupled via an operating rod 228 as shown in FIG. 4 with contact pressure spring means 230 to an operating mechanism (not shown). The closing stroke of the operating mechanism and operating rod 228 would drive the moving contact rod 28 upward. Because of the aforementioned adjustment of the threaded adjuster 68, when the spring 72 is installed the pin 62 is forced to the bottom of the slot 66 which causes the floating contact rod 52 to be pushed downward. This causes the second set of contacts to engage in advance of the first set of contacts by preferable dimension of 0.156 inch (the total length of slot 66 minus the 0.031 wear allowance). Once the second set of contacts 46 and 48 engages, electric current flows from the source terminal 208, through the second set of contacts and through the pre-insertion resistors or inductors and out the load terminal 210. As the moving contact rod 28 continues its closing stroke, the floating contact rod 52 is driven upward resulting in the pin 62 moving upward in slot 66 and compressing spring 72. The closing stroke is completed; when moving contact rod 28 is driven to the point that the first set of contacts 20 and 22 make. At this point, the electric current flows from the source terminal 208 through the first set of contacts and directly out the load terminal 210, bypassing the second set of contacts and the pre-insertion resistors or inductors 214A, 214B. The operation results in the pre-insertion resistors or inductors 214A, 214B being in the circuit for approximately ¼ cycle of the 60 cycle wave. During this time, the in-rush current experienced during energizing of parallel bank capacitors (not shown) would be damped.

Upon initiation of the opening stroke, the moving contact rod 28 moves downward causing the first set of contacts 20 and 22 to immediately part. However, the energy stored in the spring 72 forces the floating contact rod 52 downward maintaining contact through the second set of contacts 46 and 48. This re-establishes current flow through the pre-insertion resistors or inductors and results in an essentially arc-less parting of the first set of contacts. As moving contact rod 28 continues its opening stroke, the floating contact rod 52 continues to move downward, until the pin 62 is driven to the bottom of slot 66. At this point, floating contact rod 52 is no longer able to follow the contact rod 28 downward and the second set of contacts 46 and 48 begins to part initiating an arc. With the pre-insertion resistors or inductors now back in series with the circuit the transient recovery voltage transient is damped resulting in an efficient interruption of the arc as the moving contact rod 28 completes its opening stroke and provides the full open gap for the second set of contacts.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A three terminal vacuum switch, comprising:

a vacuum enclosure;

a first contact system includes a moving contact and a stationary contact, said stationary contact is retained inside said vacuum enclosure at substantially at one end thereof;

a second contact system includes a moving contact rod, a floating contact rod and a biasing means, said floating contact rod is slidably retained at the other one end of said vacuum enclosure, said biasing means is retained on the other end of said vacuum enclosure, substantially one end of said floating contact rod is retained by said biasing means, the other end of said floating contact rod is biased toward the one end of said vacuum enclosure, said moving contact is retained on said moving contact rod; and a load is electrically connected between said stationary contact and said floating rod, wherein a power source is electrically connected to said moving contact rod, said first and second contact systems are open, said moving contact rod is slid toward said floating contact rod until electrical contact is made therebetween, power from the power source flows through said load, said moving contact rod is pushed further until electrical contact is made between said stationary contact and said moving contact, said impedance load is bypassed after the electrical contact between said stationary contact and said moving contact is made.

2. The three terminal vacuum switch of claim 1, wherein:

a distance that said floating contact rod extends from said biasing means is adjustable.

3. The three terminal vacuum switch of claim 1, further comprising:

said vacuum switch is encapsulated in a solid dielectric insulation.

4. The three terminal vacuum switch of claim 1, further comprising:

said moving contact having an annular moving contact pad, said stationary contact having an annular shape, said stationary contact having an annular stationary contact pad.

5. The three terminal vacuum switch of claim 1, further comprising:

a floating contact pad is retained on an end of said floating contact rod, a moving contact pad is retained on an end of said moving contact rod.

6. The three terminal vacuum switch of claim 1, further comprising:

said biasing means includes a mechanism housing, a threaded adjuster, a compression spring and an end cap, said mechanism housing is secured to the other end of said vacuum enclosure, said threaded adjuster is theadably engaged with said mechanism housing, said threaded adjuster including a spring bore for receiving said compression spring, said end cap retaining said compression spring in said spring bore.

7. The three terminal vacuum switch of claim 6, further comprising:

at least two adjuster openings are formed through said threaded adjuster to receive an anti-rotation pin, at least two housing openings are formed through said mechanism housing to receive said anti-rotation pin and a pin hole is formed through said floating contact rod to receive said anti-rotation pin.

8. A three terminal vacuum switch, comprising:

a vacuum enclosure;

a first contact system includes a moving contact and a stationary contact, said stationary contact is retained inside said vacuum enclosure at substantially one end thereof;

a second contact system includes a moving contact rod, a floating contact rod and a biasing means, said floating contact rod is slidably retained at the other end of said vacuum enclosure, said biasing means is retained on the other end of said vacuum enclosure, substantially one end of said floating contact rod is retained by said biasing means, the other end of said floating contact rod is biased toward the one end of said vacuum enclosure, said moving contact is retained on said moving contact rod, a distance that said floating contact rod extends from said biasing means is adjustable; and a load is electrically connected between said stationary contact and said floating rod, wherein a power source is electrically connected to said moving contact rod, said first and second contact systems are open, said moving contact rod is slid toward said floating contact rod until electrical contact is made therebetween, power from the power source flows through said load, said moving contact rod is pushed further until electrical contact is made between said stationary contact and said moving contact, said impedance load is bypassed after the electrical contact between said stationary contact and said moving contact is made.

9. The three terminal vacuum switch of claim 8, further comprising:

said vacuum switch is encapsulated in a solid dielectric insulation.

10. The three terminal vacuum switch of claim 8, further comprising:

said moving contact having an annular moving contact pad, said stationary contact having an annular shape, said stationary contact having an annular stationary contact pad.

11. The three terminal vacuum switch of claim 8, further comprising:

a floating contact pad is retained on an end of said floating contact rod, a moving contact pad is retained on an end of said moving contact rod.

12. The three terminal vacuum switch of claim 8, further comprising:

said biasing means includes a mechanism housing, a threaded adjuster, a compression spring and an end cap, said mechanism housing is secured to the other end of said vacuum enclosure, said threaded adjuster is theadably engaged with said mechanism housing, said threaded adjuster including a spring bore for receiving said compression spring, said end cap retaining said compression spring in said spring bore.

13. The three terminal vacuum switch of claim 12, further comprising:

at least two adjuster openings are formed through said threaded adjuster to receive an anti-rotation pin, at least two housing openings are formed through said mechanism housing to receive said anti-rotation pin and a pin hole is formed through said floating contact rod to receive said anti-rotation pin.

14. A three terminal vacuum switch, comprising:

a vacuum enclosure;

a first contact system includes a moving contact and a stationary contact, said stationary contact is retained inside said vacuum enclosure at substantially one end thereof;

a second contact system includes a moving contact rod, a floating contact rod and a biasing means, said floating contact rod is slidably retained at the other end of said vacuum enclosure, said biasing means is retained on the other end of said vacuum enclosure, substantially one end of said floating contact rod is retained by said biasing means, the other end of said floating contact rod is biased toward the one end of said vacuum enclosure, said moving contact is retained on said moving contact rod;

a load is electrically connected between said stationary contact and said floating rod, wherein a power source is electrically connected to said moving contact rod, said first and second contact systems are open, said moving contact rod is slid toward said floating contact rod until electrical contact is made therebetween, power from the power source flows through said load, said moving contact rod is pushed further until electrical contact is made between said stationary contact and said moving contact, said impedance load is bypassed after the electrical contact between said stationary contact and said moving contact is made; and said vacuum switch is encapsulated in a solid dielectric insulation.

15. The three terminal vacuum switch of claim 14, wherein:

a distance that said floating contact rod extends from said biasing means is adjustable.

16. The three terminal vacuum switch of claim 14, further comprising:

said moving contact having an annular moving contact pad, said stationary contact having an annular shape, said stationary contact having an annular stationary contact pad.

17. The three terminal vacuum switch of claim 14, further comprising:

a floating contact pad is retained on an end of said floating contact rod, a moving contact pad is retained on an end of said moving contact rod.

18. The three terminal vacuum switch of claim 14, further comprising:

said biasing means includes a mechanism housing, a threaded adjuster, a compression spring and an end cap, said mechanism housing is secured to the other end of said vacuum enclosure, said threaded adjuster is theadably engaged with said mechanism housing, said threaded adjuster including a spring bore for receiving said compression spring, said end cap retaining said compression spring in said spring bore.

19. The three terminal vacuum switch of claim 18, further comprising:

at least two adjuster openings are formed through said threaded adjuster to receive an anti-rotation pin, at least two housing openings are formed through said mechanism housing to receive said anti-rotation pin and a pin hole is formed through said floating contact rod to receive said anti-rotation pin.

* * * * *